US009156152B2

(12) United States Patent
Machida

(10) Patent No.: US 9,156,152 B2
(45) Date of Patent: Oct. 13, 2015

(54) IMPACT TOOL HAVING COUNTER WEIGHT THAT REDUCES VIBRATION

(75) Inventor: Yoshitaka Machida, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 527 days.

(21) Appl. No.: 13/594,285

(22) Filed: Aug. 24, 2012

(65) Prior Publication Data

US 2013/0048327 A1 Feb. 28, 2013

(30) Foreign Application Priority Data

Aug. 31, 2011 (JP) ..... 2011-189352
Aug. 31, 2011 (JP) ..... 2011-189356

(51) Int. Cl.
*B25D 17/24* (2006.01)
*B25D 11/06* (2006.01)

(52) U.S. Cl.
CPC ..... *B25D 17/24* (2013.01); *B25D 11/062* (2013.01); *B25D 2217/0088* (2013.01); *B25D 2217/0092* (2013.01); *B25D 2250/051* (2013.01)

(58) Field of Classification Search
CPC . B25D 17/24; B25D 11/062; B25B 2250/391
USPC ..... 173/162.1, 162.2, 217, 170
See application file for complete search history.

(56) References Cited

U.S. PATENT DOCUMENTS

2008/0047723 A1 2/2008 Kamegai et al.
2010/0270046 A1 10/2010 Schlesak et al.

FOREIGN PATENT DOCUMENTS

CN 101062558 A 10/2007
JP A-2008-073836 4/2008

OTHER PUBLICATIONS

Office Action issued in Chinese Application No. 201210316386.8 dated Jul. 3, 2014 (with translation).
Nov. 26, 2014 Office Action issued in Chinese Application No. 201210316386.8.
Dec. 24, 2014 Office Action issued in Japanese Application No. 2011-189356.
Dec. 24, 2014 Office Action issued in Japanese Application No. 2011-189352.

*Primary Examiner* — Michelle Lopez
(74) *Attorney, Agent, or Firm* — Oliff PLC

(57) ABSTRACT

An impact tool is provided with a rational structure of connecting a ring-like member and a counter weight. The impact tool has a tool body, a motor, a drive shaft, a ring-like member that is caused to swing in an axial direction of a tool bit by rotation of the drive shaft, a tool driving mechanism, that is connected to the ring-like member and caused to rectilinearly move in the axial direction of the tool bit, and a counter weight that reduces vibration caused in the tool body in the axial direction of the tool bit. The counter weight has a connecting part that comes in contact with an outer edge of the ring-like member in at least one of axial directions of the tool bit, and the counter weight is connected to the ring-like member via the connecting part.

13 Claims, 9 Drawing Sheets

IMPACT TOOL HAVING COUNTER WEIGHT THAT REDUCES VIBRATION

Cross reference is made to the Japanese patent application JP 2011-189356 filed on Aug. 31, 2011 and JP 2011-189352 filed on Aug. 31, 2011, the entire contents of which are herein incorporated by reference.

BACKGROUND OF THE INVENTION

1. Field of the Invention

The invention relates to a technique of reducing vibration of an impact tool, such as a hammer and a hammer drill, which rectilinearly drives a tool bit in a constant cycle.

2. Description of the Related Art

Japanese non-examined laid-open Patent Publication No. 2008-73836 discloses a vibration reducing mechanism of an impact tool that drives a tool driving mechanism by a ring-like member which is caused to swing in an axial direction of a rotary shaft by rotation of the rotary shaft and thus causes a tool bit to perform axial striking movement. This known vibration reducing mechanism is of a type that reduces vibration by a counter weight. The counter weight is connected to the ring-like member with a phase difference of about 180 degrees (opposite phase) in a circumferential direction from a connection between the ring-like member and a cylindrical piston (piston cylinder) of the tool driving mechanism. With such a construction, the counter weight is caused to move in the axial direction of the tool bit by swinging movement of the ring-like member, so that vibration caused in the axial direction of the tool bit during operation is reduced.

In the known vibration reducing mechanism using a counter weight, the structure of connecting the ring-like member and the counter weight has a radially extending columnar protrusion formed on an outer circumferential surface of the ring-like member and an engagement hole formed in the counter weight such that the connection is made by loosely inserting the protrusion into the engagement hole. Therefore, both the ring-like member and the counter weight must be specially designed for the connection.

SUMMARY OF THE INVENTION

Accordingly, it is an object of the invention to provide an impact tool with a rational structure of connecting a ring-like member and a counter weight.

In order to solve the above-described problem, in a preferred embodiment according to the present invention, an impact tool is provided which performs a predetermined operation on a workpiece by axial striking movement of a tool bit coupled to a front end region of a tool body. The impact tool has a motor that is housed in the tool body, a drive shaft that is disposed in parallel to an axial direction of the tool bit and rotationally driven by the motor, a ring-like member that is rotatably mounted onto the drive shaft and caused to swing in the axial direction of the tool bit by rotation of the drive shaft, a tool driving mechanism that is connected to one end region of the ring-like member in a direction transverse to the axial direction of the tool bit and is caused to rectilinearly move in the axial direction of the tool bit by swinging movement of the ring-like member and thereby rectilinearly drives the tool bit, and a counter weight that reduces vibration which is caused in the tool body in the axial direction of the tool bit during operation. The counter weight has a connecting part that comes in contact with an outer edge of the ring-like member in at least one of axial directions of the tool bit, and the counter weight is connected to the ring-like member via the connecting part.

According to the present invention, when the tool bit is rectilinearly driven via the tool driving mechanism by swinging movement of the ring-like member in order to perform a predetermined operation, the counter weight is driven by the ring-like member and reduces impulsive vibration which is caused in the tool body in the axial direction of the tool bit.

According to the present invention, with the construction in which the connection between the ring-like member and the counter weight is made by the connecting part provided in the counter weight, the structure of connecting the ring-like member and the counter weight is rationalized, which is effective in structure simplification and manufacturing cost reduction.

According to a further embodiment of the impact tool of the present invention, the connecting part is formed in the counter weight and comprises a protrusion that comes in contact with the outer edge of the ring-like member in both axial directions of the tool bit. The manner of "coming in contact with the outer edge of the ring-like member in both directions" can be typically realized by providing the protrusion having a concave section.

According to this embodiment, with the construction in which the counter weight and the ring-like member are connected to each other via the protrusion formed in the counter weight, it is not necessary for the ring-like member to have a special shape, configuration or structure designed to be connected to the counter weight, so that the connecting structure can be made simpler and the manufacturing costs can be reduced.

According to a further embodiment of the impact tool of the present invention, the connecting part is formed in the counter weight and has a protrusion that comes in contact with the outer edge of the ring-like member in the one axial direction of the tool bit, and a biasing member that applies a biasing force to constantly hold the protrusion in contact with the outer edge of the ring-like member.

Also in this case, it is not necessary for the ring-like member to have a special shape, configuration or structure designed to be connected to the counter weight, so that the connecting structure can be made simpler and the manufacturing costs can be reduced. Further, the protrusion can be constantly held in contact with the outer edge of the ring-like member, so that vibration and noise can be avoided which may be caused if the outer edge and the protrusion hit against each other.

According to a further embodiment of the impact tool of the present invention, the counter weight has a center of rotation close to a connection between the ring-like member and the cylindrical piston. When the ring-like member is caused to swing, the counter weight is driven by the ring-like member to perform circular arc motion on the center of rotation in the axial direction of the tool bit, thereby reducing vibration in the axial direction of the tool bit.

According to this embodiment, with the construction in which the center of rotation of the counter weight which performs circular arc motion is provided close to the connection between the ring-like member and the cylindrical piston, the distance from the center of rotation of the counter weight to the connecting part between the ring-like member and the counter weight can be shortened compared with the known construction in which the counter weight is driven in the direction opposite to the direction of movement of the cylindrical piston. As a result, the width of circular arc motion of the counter weight can be increased and the counter weight can be correspondingly reduced in weight.

According to a further embodiment of the impact tool of the present invention, the tool driving mechanism has a cylindrical piston that is connected to the ring-like member and caused to rectilinearly move in the axial direction of the tool bit by swinging movement of the ring-like member, and a striking element that is caused to rectilinearly move in the axial direction of the tool bit via pressure fluctuations caused within the cylindrical piston by rectilinear movement of the cylindrical piston, and thereby rectilinearly drives the tool bit. Further, the ring-like member is connected to the counter weight at a position displaced a predetermined distance forward in a direction of rotation of the drive shaft from a position diametrically opposite to the one end region of the ring-like member at which the ring-like member is connected to the cylindrical piston.

According to the present invention, when the cylindrical piston is caused to rectilinearly move by swinging movement of the ring-like member, the striking element rectilinearly drives the tool bit via pressure fluctuations caused in the cylindrical piston so that a predetermined operation is performed. At this time, the counter weight is caused to move in the axial direction of the tool bit by the ring-like member and thereby reduces impulsive vibration which is caused in the tool body in the axial direction of the tool bit. In the impact tool that drives the striking element via pressure fluctuations in the cylindrical piston, a space (air chamber) defined by a bore of the cylindrical piston and the striking element reaches maximum pressure before the cylindrical piston comes closest to the tool bit. The timing at which an impact force is generated includes the above-described time at which the air chamber reaches maximum pressure, the time at which the striking element collides with an object to strike in the form of the tool bit (or with an impact bolt if an intermediate element in the form of the impact bolt is provided between the striking element and the tool bit) and the time at which the tool bit strikes the workpiece, all of which are before the cylindrical piston comes closest to the tool bit.

In the present invention, in view of the above-described timing of generation of the impact force, the ring-like member is connected to the counter weight at a predetermined distance forward in the direction of rotation of the drive shaft from a position diametrically opposite to the connection of the ring-like member with the cylindrical piston. By provision of this construction, the counter weight can be driven in response to the timing at which the impact force is generated in the tool body in the axial direction of the tool bit. Therefore, compared with the known construction in which the counter weight is driven in a direction opposite to the direction of movement of the cylindrical piston, the vibration reducing effect of the counter weight can be improved.

According to a further embodiment of the impact tool of the present invention, the counter weight has a center of gravity between the connection of the tool driving mechanism with the ring-like member and a rotation axis of the drive shaft.

According to this embodiment, the center of gravity of the counter weight can be brought closer to the axis of the tool bit. Therefore, when the counter weight is driven by the ring-like member, unnecessary vibration which is caused by couple of forces generated around a horizontal axis transverse to the rotation axis of the drive shaft can be reduced.

Further, according to another aspect of the invention, an impact tool may preferably be provided to include: a motor that is housed in the tool body, a drive shaft that is disposed in parallel to an axial direction of the tool bit and rotationally driven by the motor, a ring-like member that is rotatably mounted onto the drive shaft and caused to swing in the axial direction of the tool bit by rotation of the drive shaft, a cylindrical piston that is connected to one end region of the ring-like member in a direction transverse to the axial direction of the tool bit and is caused to rectilinearly move in the axial direction of the tool bit by swinging movement of the ring-like member, a striking element that is caused to rectilinearly move in the axial direction of the tool bit via pressure fluctuations caused within the cylindrical piston by rectilinear movement of the cylindrical piston, and thereby rectilinearly drives the tool bit, and a counter weight that is mounted movably in the axial direction of the tool bit and reduces vibration which is caused in the tool body in the axial direction of the tool bit during operation, wherein the ring-like member is connected to the counter weight at a position displaced a predetermined distance forward in a direction of rotation of the drive shaft from a position diametrically opposite to the one end region of the ring-like member at which the ring-like member is connected to the cylindrical piston. By provision of this construction, the counter weight can be driven in response to the timing at which the impact force is generated in the tool body in the axial direction of the tool bit. Therefore, compared with the known construction in which the counter weight is driven in a direction opposite to the direction of movement of the cylindrical piston, the vibration reducing effect of the counter weight can be improved.

According to the present invention, the impact tool is provided with a rational structure of connecting a ring-like member and a counter weight. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved impact tools and method for using such impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment of the Invention

Figure 1:
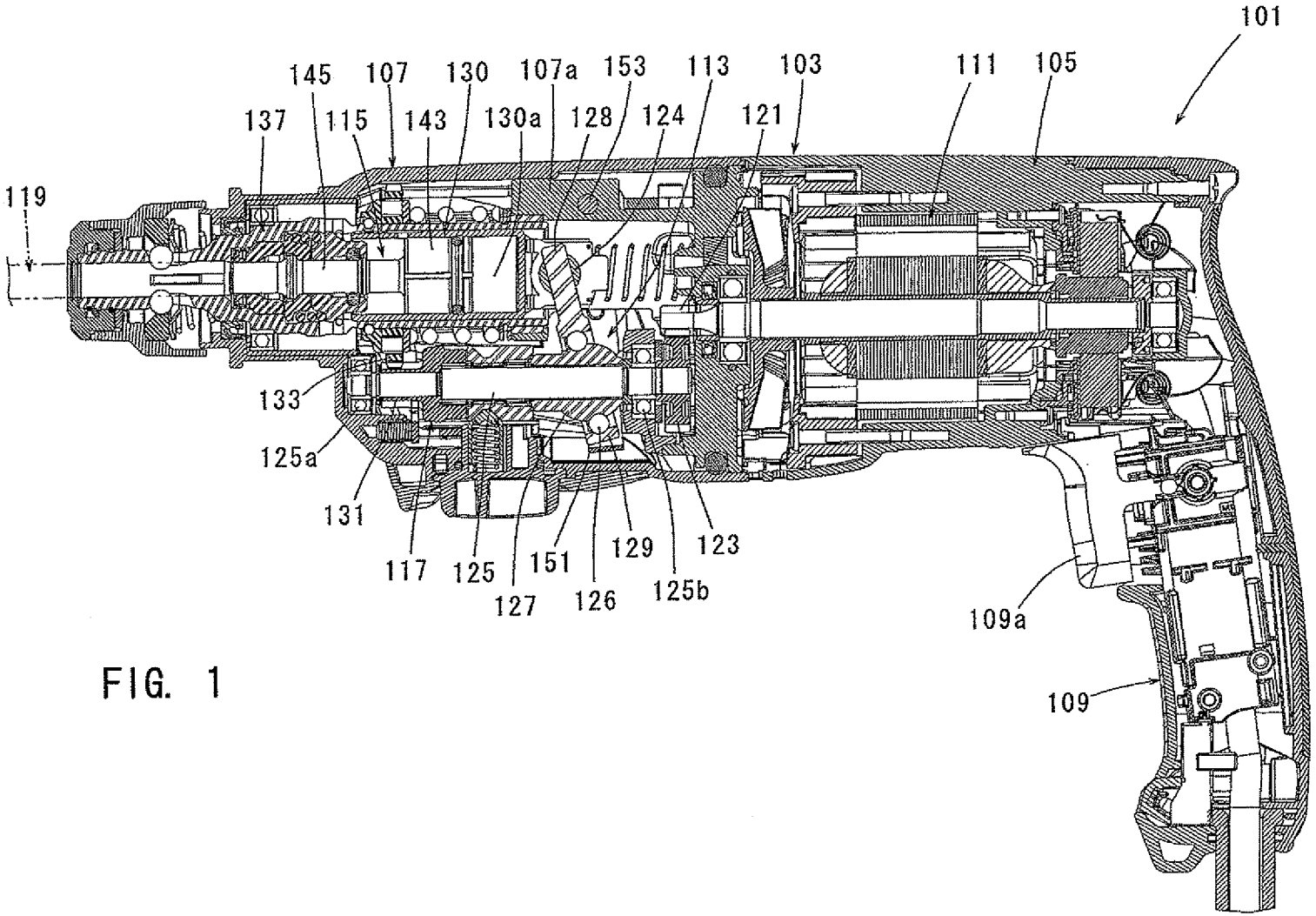
FIG. 1 is a sectional view schematically showing an entire hammer drill according to a first embodiment of the present invention.

A first embodiment of the present invention is now described with reference to FIGS. 1 to 9. In this embodiment, an electric hammer drill is explained as a representative embodiment of an impact tool. As shown in FIG. 1, a hammer drill 101 mainly includes a body 103 that forms an outer shell of the hammer drill 101. A hammer bit 119 is detachably coupled to a front end region of the body 103 via a cylindrical tool holder 137 such that it can move in its axial direction with respect to the tool holder 137 and rotates together with the tool holder 137 in its circumferential direction. A handgrip 109 designed to be held by a user is connected to the body 103 on the side opposite to the front end region. The body 103 and the hammer bit 119 are features that correspond to the "tool body" and the "tool bit", respectively, in the present invention. Further, for the sake of convenience of explanation, the hammer bit 119 side is taken as the front, and the handgrip 109 side as the rear.

The body 103 mainly includes a motor housing 105 that houses a driving motor 111, and a gear housing 107 that houses a motion converting mechanism 113, a striking mechanism 115 and a power transmitting mechanism 117. The driving motor 111 is a feature that corresponds to the "motor" in the present invention. The motion converting mechanism 113 appropriately converts rotating output of the driving motor 111 into linear motion and transmits it to the striking mechanism 115. As a result, an impact force is generated in an axial direction (a horizontal direction as viewed in FIG. 1) of the hammer bit 119 via the striking mechanism 115. Further, the power transmitting mechanism 117 appropriately reduces the speed of the rotating output of the driving motor 111 and then transmits it to the hammer bit 119. As a result, the hammer bit 119 is caused to rotate in a circumferential direction. The driving motor 111 is driven by depressing a trigger 109*a* disposed on the handgrip 109.

The motion converting mechanism 113 mainly includes a driving gear 121 that is rotationally driven in a vertical plane by the driving motor 111, a driven gear 123 that engages with the driving gear 121, a rotating element 127 that rotates together with the driven gear 123 via an intermediate shaft 125, a generally annular swinging ring 129 that is caused to swing in the axial direction of the hammer bit 119 by rotation of the rotating element 127, and a cylindrical piston 130 having a bottom that is caused to reciprocate by swinging movement of the swinging ring 129. The intermediate shaft 125 and the swinging ring 129 are features that correspond to the "drive shaft" and the "ring-like member", respectively, in the present invention.

The intermediate shaft 125 is disposed in parallel (horizontally) to the axial direction of the hammer bit 119 and rotatably supported at its both axial ends by front and rear bearings 125*a*, 125*b*. An outer circumferential surface of the rotating element 127 fitted onto the intermediate shaft 125 is inclined at a predetermined angle with respect to the axis of the intermediate shaft 125. The swinging ring 129 is rotatably fitted and supported on the inclined outer circumferential surface of the rotating element 127 via a bearing 126, and is caused to swing in the axial direction of the hammer bit 119 by rotation of the rotating element 127. Further, when the swinging ring 129 swings, the amounts of swinging movement of arbitrary points on the same circumference of the swinging ring 129 around the axis of the intermediate shaft 125 are equal to each other. The rotating element 127 which rotates together with the intermediate shaft 125 and the swinging ring 129 which is rotatably supported on the rotating element 127 via the bearing 126 form a swinging mechanism.

A columnar swinging rod 128 extends in a radial direction from an upper end region of the swinging ring 129 and loosely inserted in a radial direction through a connecting shaft 124 provided in a rear end of the cylindrical piston 130. Thus, the swinging ring 129 is connected to the cylindrical piston 130 via the swinging rod 128 and the connecting shaft 124. Further, the connecting shaft 124 can rotate around a horizontal axis transverse to the axis of the hammer bit 119. The cylindrical piston 130 is slidably disposed within a rear cylindrical portion of the tool holder 137 and caused to rectilinearly slide along the inner wall of the tool holder 137 by the swinging movement (its components in the axial direction of the hammer bit 119) of the swinging ring 129. When the swinging rod 128 tilts as far forward as possible (toward the hammer bit), the cylindrical piston 130 is placed in a front end position. When the swinging rod 128 tilts as far rearward as possible (toward the hand grip), the cylindrical piston 130 is placed in a rear end position. In the following description, the front end position of the cylindrical piston 130 is referred to as a top dead point and the rear end position as a bottom dead point.

The striking mechanism 115 mainly includes a striking element in the form of a striker 143 that is slidably disposed within the bore of the cylindrical piston 130, and an intermediate element in the form of an impact bolt 145 that is slidably disposed within a front cylindrical portion of the tool holder 137 and transmits kinetic energy (striking force) of the striker 143 to the hammer bit 119. The striker 143 is driven via pressure fluctuations (an action of an air spring) which are caused by the sliding movement of the cylindrical piston 130 within an air chamber 130*a* of the cylindrical piston 130. The striker 143 then collides with (strikes) the impact bolt 145 that is slidably disposed within the cylindrical tool holder 137, and transmits the striking force to the hammer bit 119 via the impact bolt 145. The cylindrical piston 130 and the striker 143 form the "tool driving mechanism" in the present invention. The cylindrical piston 130 and the striker 143 are features that correspond to the "cylindrical piston" and the "striking element", respectively, in the present invention.

The power transmitting mechanism 117 mainly includes a first transmission gear 131 that is mounted on the intermediate shaft 125 on the opposite side of the swinging ring 129 from the driven gear 123, a second transmission gear 133 that engages with the first transmission gear 131 and is caused to rotate around the axis of the hammer bit 119, and a final axis in the form of the tool holder 137 that is caused to rotate together with the coaxially-mounted second transmission gear 133 around the axis of the hammer bit 119. The rotating output of the intermediate shaft 125 which is rotationally driven by the driving motor 111 is transmitted from the first transmission gear 131 to the hammer bit 119 held by the tool holder 137 via the second transmission gear 133. The tool holder 137 is generally cylindrical and held by the gear housing 107 such that it can rotate around the axis of the hammer bit 119. Further, the tool holder 137 has the front cylindrical portion which houses and holds a shank of the hammer bit 119 and the impact bolt 145, and the rear cylindrical portion which extends rearward from the front cylindrical portion and slidably houses and holds the cylindrical piston 130.

In the hammer drill 101 constructed as described above, when the driving motor 111 is driven by user's depressing operation of the trigger 109*a* and the rotating element 127 is rotationally driven together with the intermediate shaft 125, the swinging ring 129 is caused to swing in the axial direction of the hammer bit 119, which in turn causes the cylindrical piston 130 to rectilinearly slide within the tool holder 137. The striker 145 is then caused to rectilinearly move within the cylindrical piston 130 by air pressure fluctuations which are caused in the air chamber 130*a* by the sliding movement of the cylindrical piston 130. The striker 143 then collides with the impact bolt 145 and transmits the kinetic energy caused by the collision to the hammer bit 119.

When the first transmission gear 131 is caused to rotate together with the intermediate shaft 125, the tool holder 137 is caused to rotate in a vertical plane via the second transmission gear 133 engaged with the first transmission gear 131, which in turn causes the hammer bit 119 held by the tool holder 137 to rotate together with the tool holder 137. In this manner, a drilling operation is performed on a workpiece (concrete) by axial hammering movement and circumferential drilling movement of the hammer bit 119.

A vibration reducing mechanism which is provided in order to reduce impulsive and cyclic vibration caused in the axial direction of the hammer bit 119 during operation of the hammer drill 101 is now explained with reference to FIGS. 2 to 9. The vibration reducing mechanism according to this embodiment mainly includes a counter weight 151 that is driven by the swinging ring 129. The counter weight 151 is a feature that corresponds to the "counter weight" in the present invention.

Figure 3:
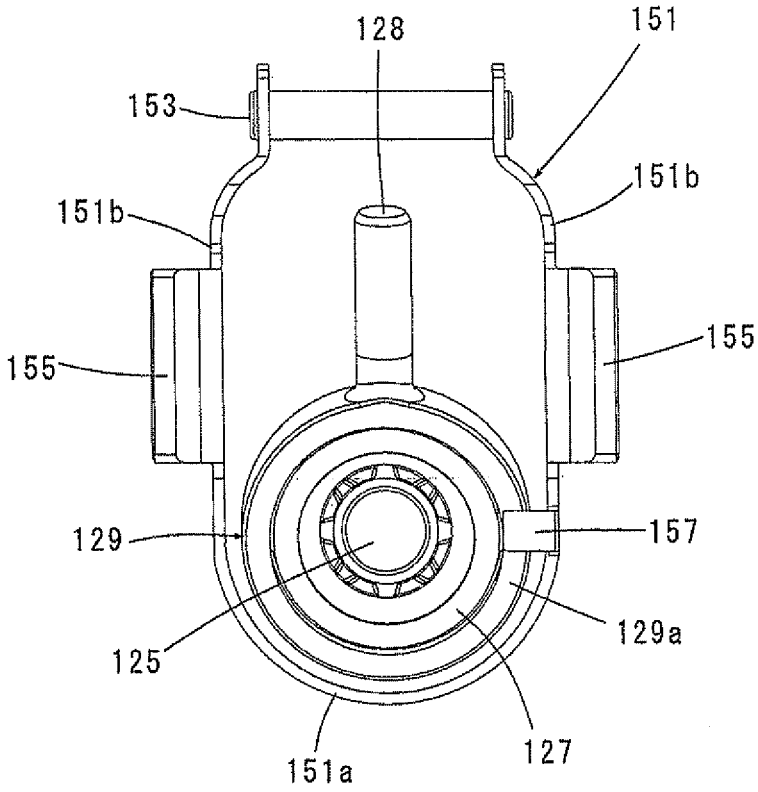
FIG. 3 is a view schematically showing a vibration reducing mechanism as viewed from a hammer bit side (from the front).

The counter weight 151 is formed by processing a generally band-like metal plate, and as shown in FIG. 3, generally U-shaped with an open top as viewed from the front or rear of the hammer drill 101. The counter weight 151 has a semicircular part 151*a* (bottom of the U shape) and right and left parallel elongate arms 151*b* extending upward from the semicircular part 151*a*. The semicircular part 151*a* is disposed around a generally lower half region of the swinging ring 129. The right and left arms 151*b* extend upward across the axis of the hammer bit 119 and their extending ends are rotatably supported by a shaft 153 which extends in a horizontal direction (transverse direction) transverse to the axial direction of the hammer bit 119. By provision of this construction, the counter weight 151 performs circular arc motion (swing motion) including a tangential component on the shaft 153 in the fore-and-aft direction or the axial direction of the hammer bit 119. Hereinafter, this circular arc motion is referred to merely as circular arc motion in the axial direction of the hammer bit 119. Further, the shaft 153 is mounted to an inner housing 107*a* (see FIG. 1) which is provided within the gear housing 107.

Weight concentrated portions 155 for weight increase are provided generally in the middle of the right and left arms 151*b* of the counter weight 151 in the extending direction. By provision of the weight concentrated portions 155, the weight required for vibration reduction is secured and the center of gravity of the counter weight 151 can be adjusted to come closer to the axis of the hammer bit 119.

The counter weight 151 has a concave engagement part 157 and is connected to the swinging ring 129 via the concave engagement part 157 at a position displaced a predetermined angle, "for example, about 90 degrees" forward from a position diametrically opposite to the connection (formed by the swinging rod 128 and the connecting shaft 124) between the swinging ring 129 and the cylindrical piston 130 (about 270 degrees forward as viewed from the connection between the swinging ring 129 and the cylindrical piston 130) in a direction of rotation of the intermediate shaft 125 and the rotating element 127 (counterclockwise as viewed in FIG. 3). The concave engagement part 157 is a feature that corresponds to the "connecting part" in the present invention.

When the swinging rod 128 of the swinging ring 129 swings rearward, a right region of the swinging ring 129 with respect to the axis of the swinging rod 128 as viewed in FIG. 3 swings forward and a left region of the swinging ring 129 swings rearward. On the other hand, when the swinging rod 128 swings forward, the right region of the swinging ring 129 swings rearward and the left region swings forward. Therefore, in this embodiment, the counter weight 151 is connected to the right region of the swinging ring 129.

Specifically, in this embodiment, the counter weight 151 is connected to the swinging ring 129 such that the counter weight 151 is placed in the rear end in the axial direction of the hammer bit when the cylindrical piston 130 is in a middle region on the way from the bottom dead point (rear end position) to the top dead point (front end position), while the counter weight 151 is placed in the front end in the axial direction of the hammer bit when the cylindrical piston 130 is in a middle region on the way from the top dead point to the bottom dead point. Further, when the cylindrical piston 130 reaches the bottom dead point or top dead point, the counter weight 151 is placed in a generally middle position between the front end and the rearmost end in the axial direction of the hammer bit.

Figure 4:
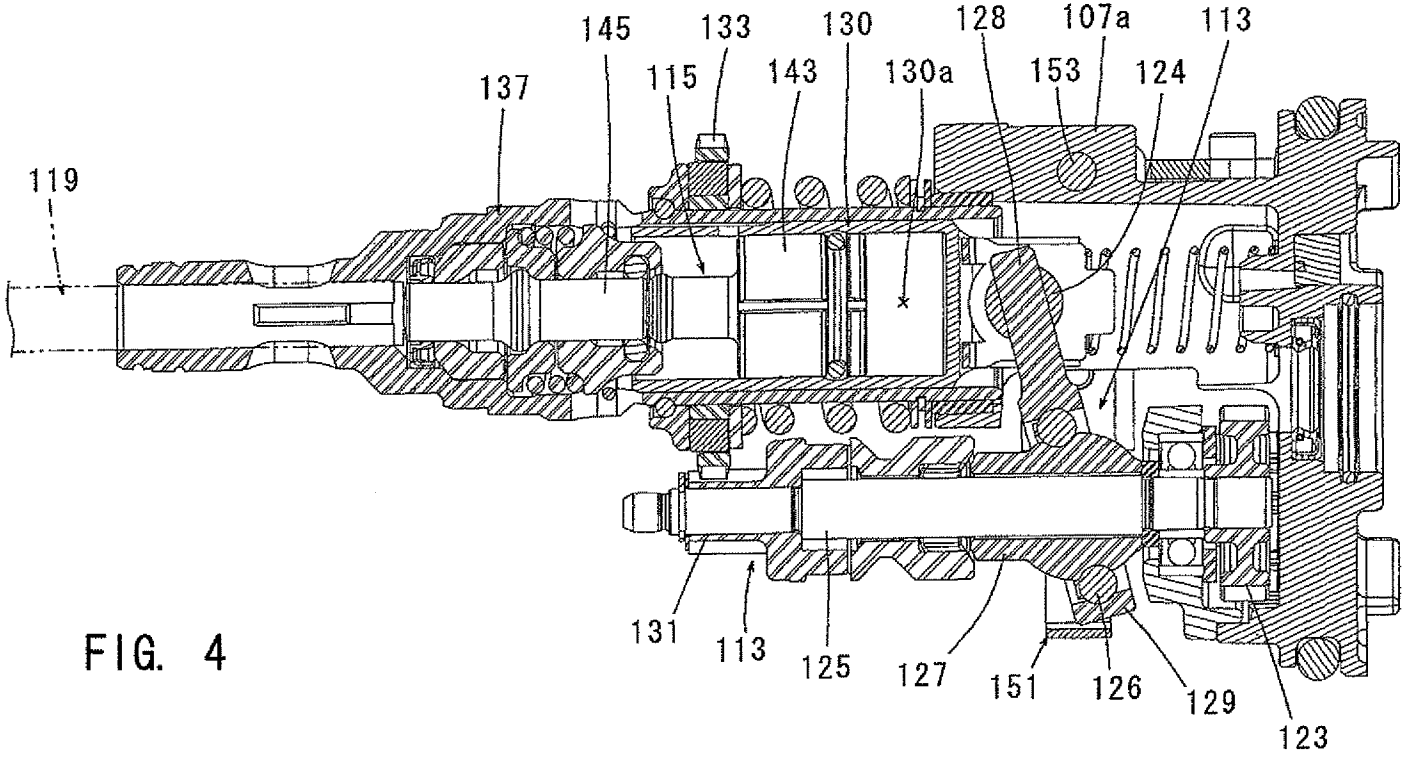
FIG. 4 is a sectional view schematically showing a state in which a cylindrical piston is on the hammer bit side (at a top dead point).
Figure 5:
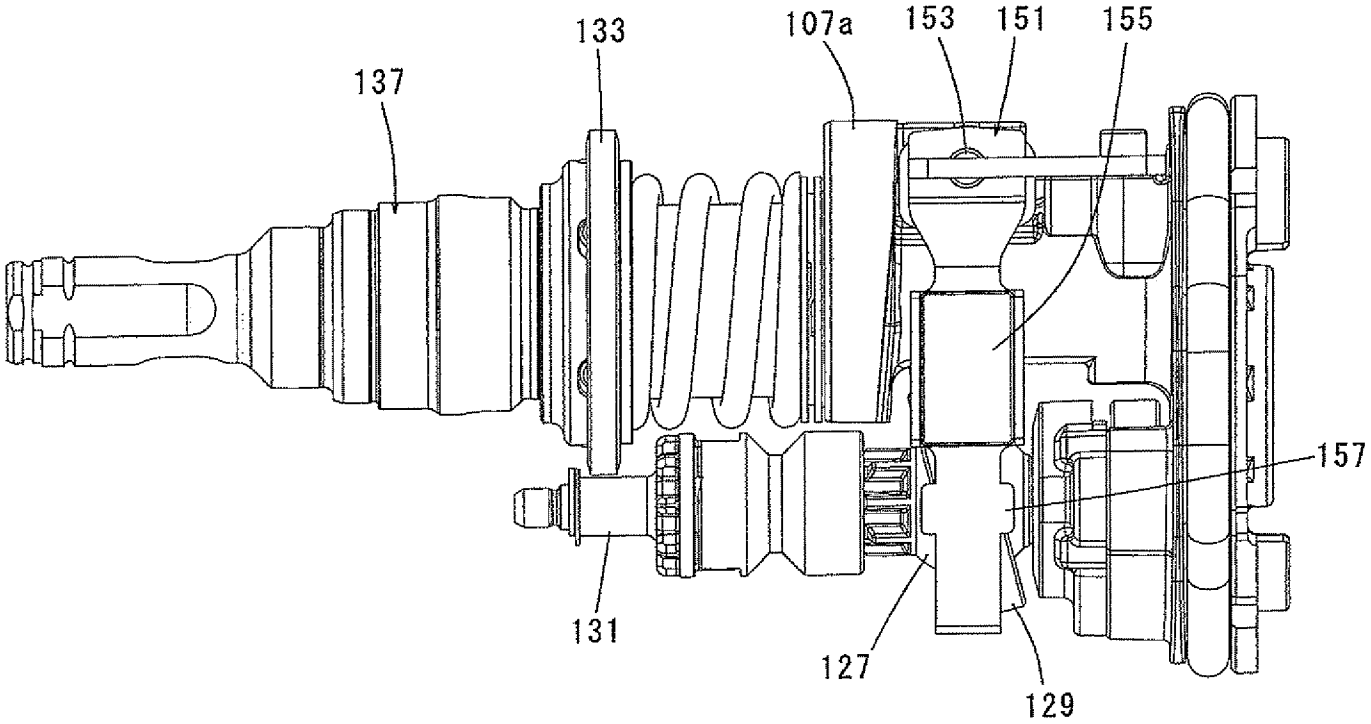
FIG. 5 is an external view for showing the position of the counter weight when the cylindrical piston is on the hammer bit side.
Figure 6:
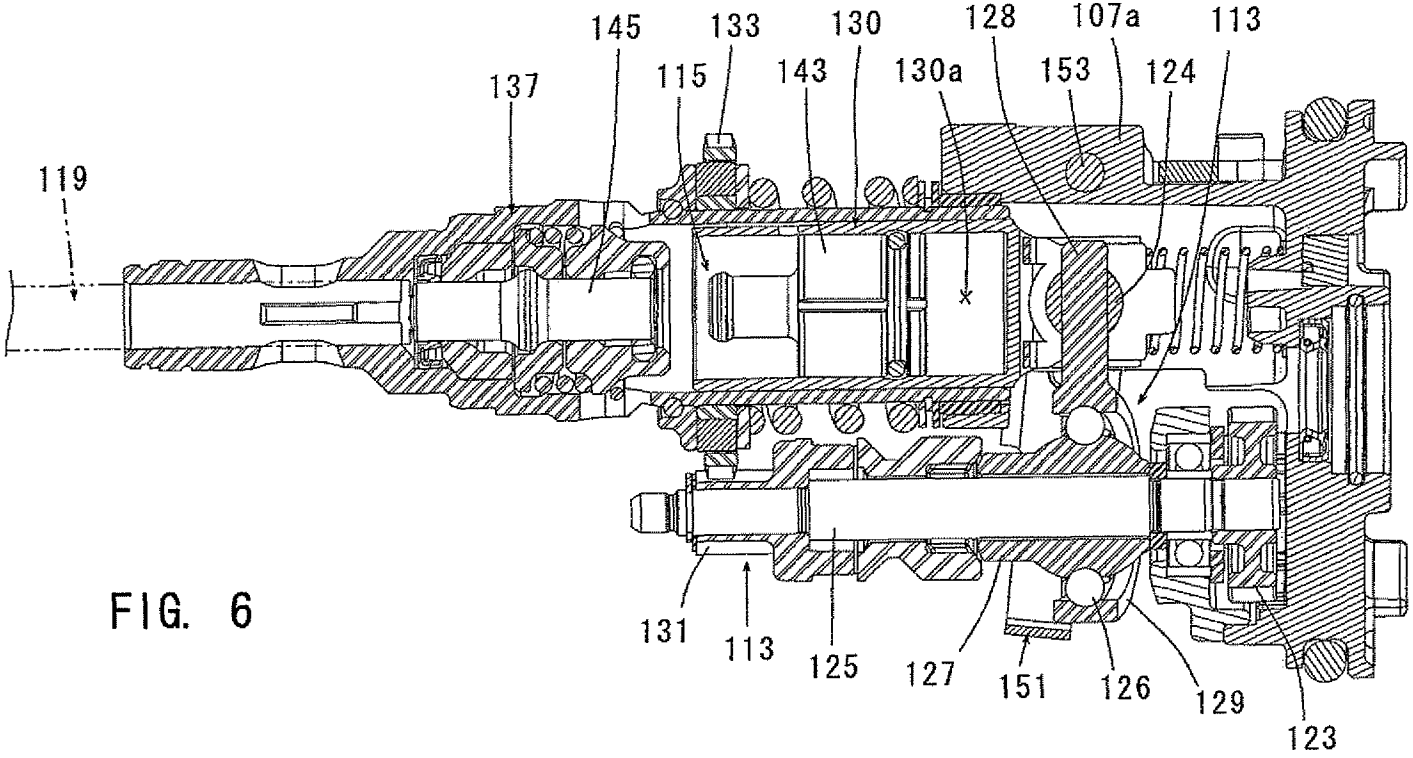
FIG. 6 is a sectional view showing a state in which the cylindrical piston is in a middle region between the hammer bit side and a handgrip side (bottom dead point).
Figure 7:
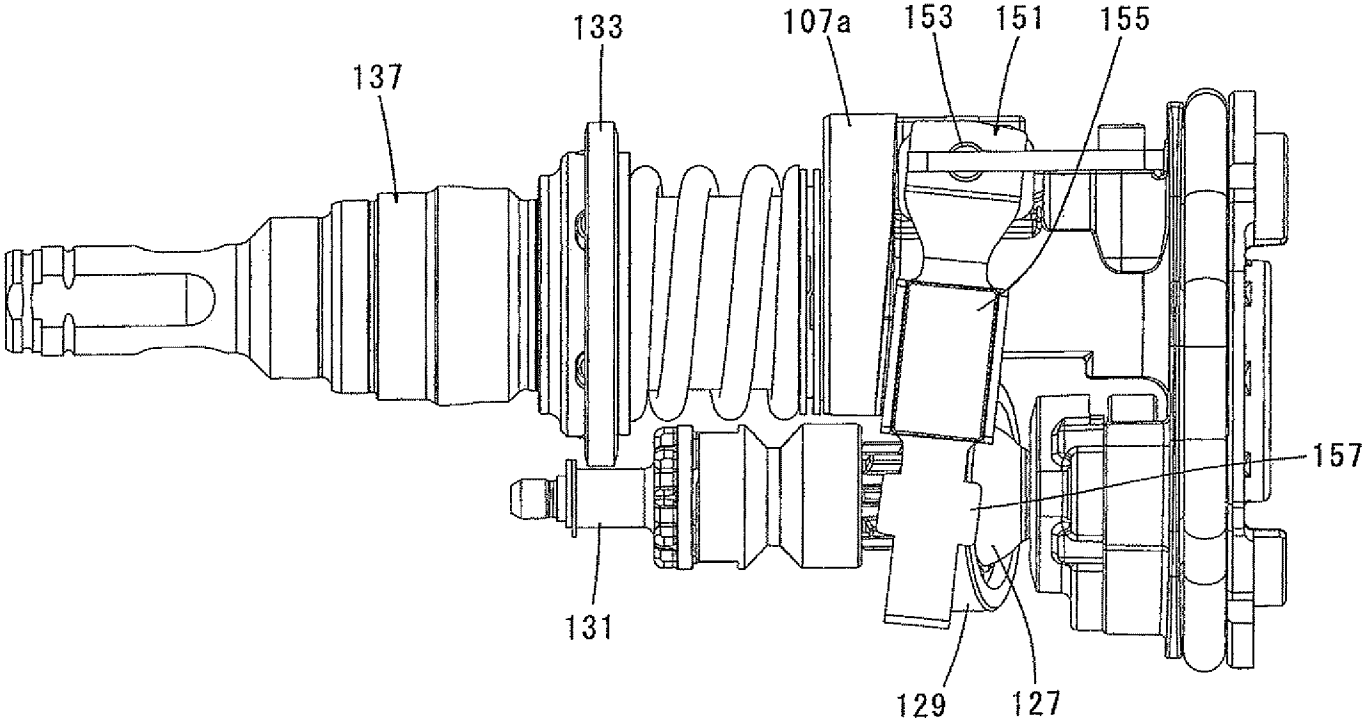
FIG. 7 is an external view for showing the position of the counter weight when the cylindrical piston is in the middle region.
Figure 8:
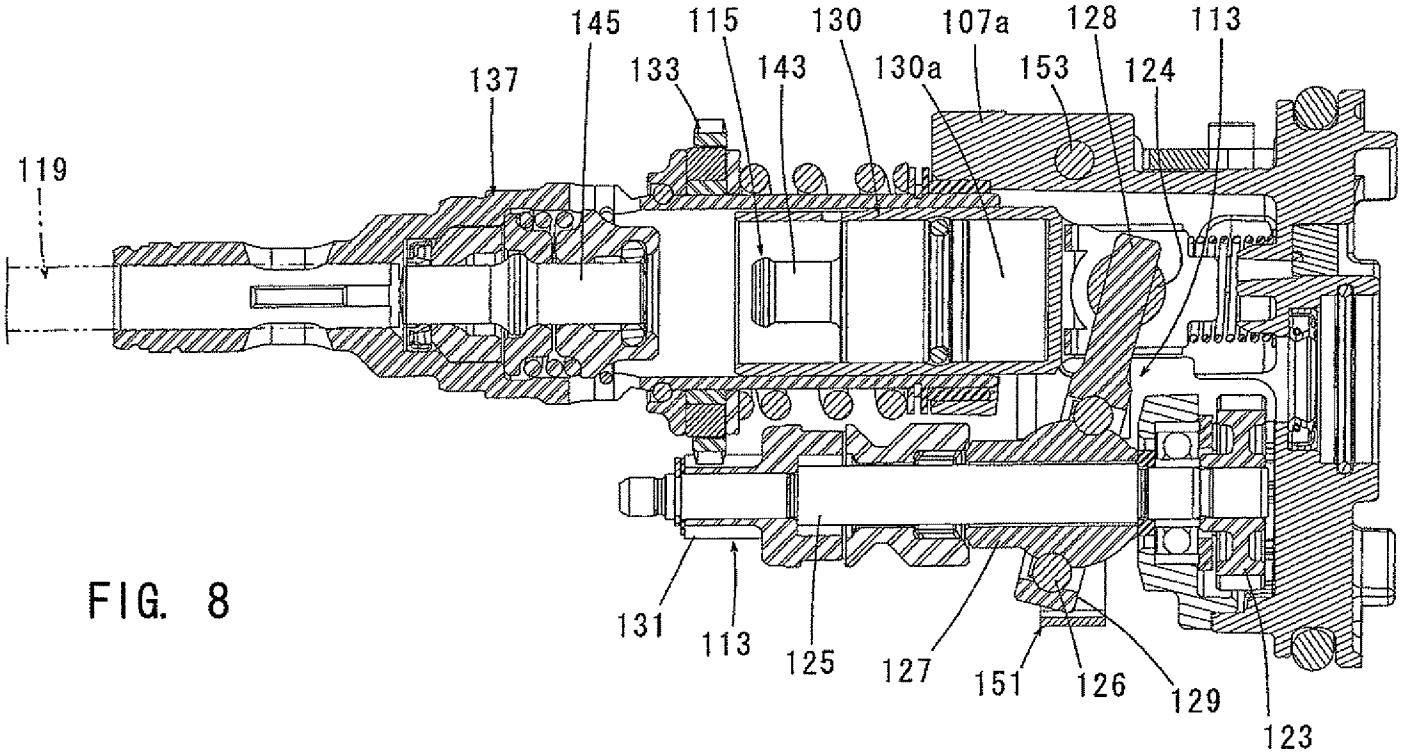
FIG. 8 is a sectional view showing a state in which the cylindrical piston is on the handgrip side.
Figure 9:
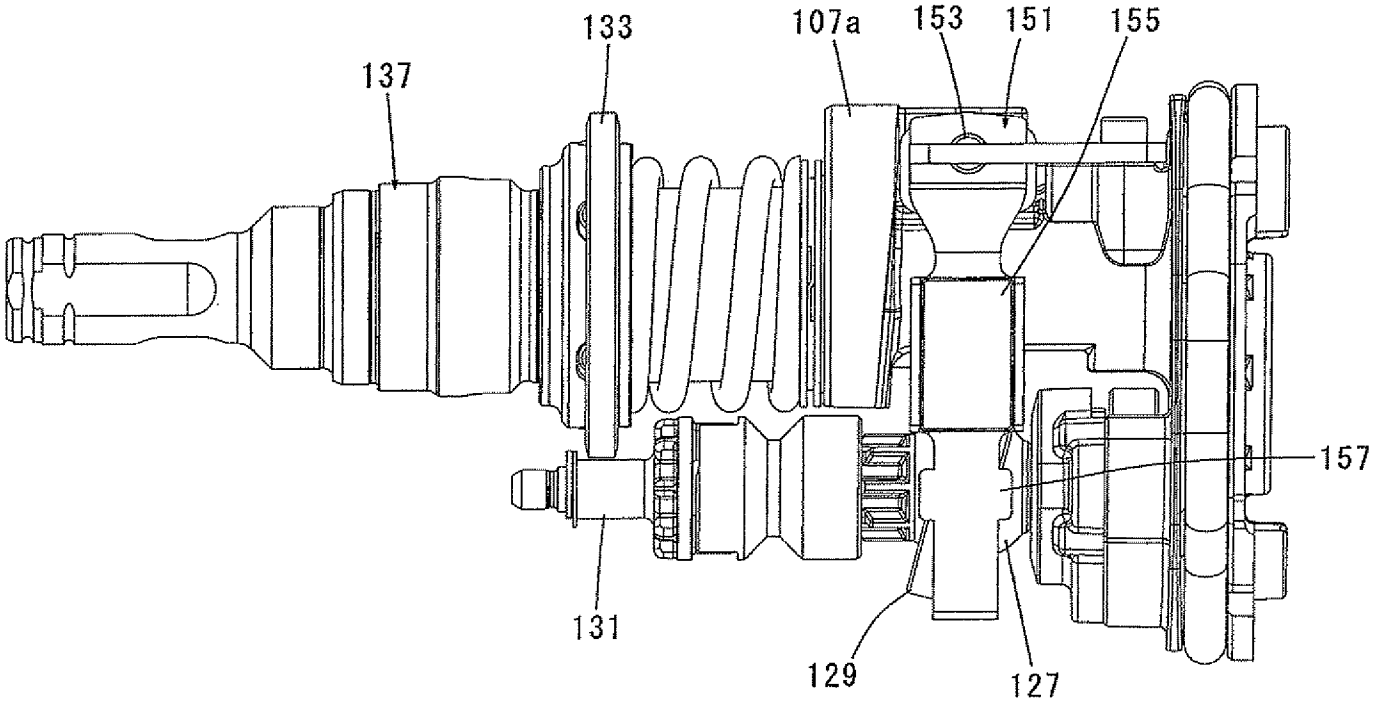
FIG. 9 is an external view for showing the position of the counter weight when the cylindrical piston is on the handgrip side.

FIG. 4 shows the state in which the cylindrical piston 130 is at the top dead point, FIG. 6 shows the state in which the cylindrical piston 130 is in the middle region between the bottom dead point and the top dead point, and FIG. 8 shows the state in which the cylindrical piston 130 is at the bottom dead point. By provision of the above-described connection between the counter weight 151 and the swinging ring 129, the counter weight 151 is placed in the middle position between the front end and the rearmost end in the axial direction of the hammer bit when the cylindrical piston 130 is at the top dead point or bottom dead point (see FIGS. 5 and 9), while the counter weight 151 is placed in the front end (see FIG. 7) or rearmost end (not shown) in the axial direction of the hammer bit when the cylindrical piston 130 is in the middle region between the top dead point and the bottom dead point.

Figure 2:
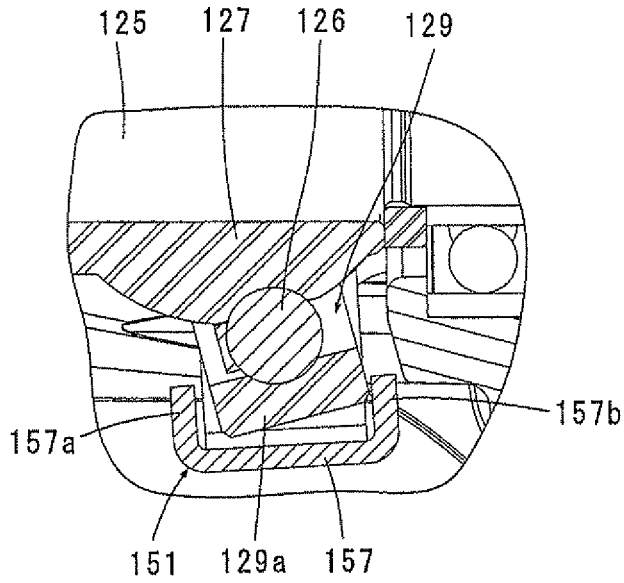
FIG. 2 is a partial sectional view showing a structure of connecting a counter weight to a swinging ring and taken at a position displaced 90 degrees in a circumferential direction as viewed from a sectional position of FIG. 1.

As described above, the counter weight 151 according to this embodiment is formed of a metal plate by sheet metal processing. Therefore, in this sheet metal processing of the counter weight 151, as shown in FIG. 2, the concave engagement part 157 is formed as a connecting part having a generally C-shaped section by bending in the connecting region between the semicircular part 151*a* and one of the arms 151*b*. The concave engagement part 157 has front and rear flat parts 157*a*, 157*b* opposed to each other and protruding in parallel toward the center of the semicircular part 151*a*. The concave engagement part 157 is fitted on an outer edge 129*a* of the swinging ring 129 from radially outward and can come in contact with the outer edge 129*a* in both axial directions of the hammer bit 119. When the swinging ring 129 swings, the concave engagement part 157 is pressed by the front or rear side of the outer edge 129*a*, so that the swinging movement of the swinging ring 129 is transmitted to the counter weight 151. Specifically, the counter weight 151 is interlocked with swinging movement (its components in the axial direction of the hammer bit 119) of the swinging ring 129 via the concave engagement part 157. The front and rear flat parts 157*a*, 157*b* are features that correspond to the "protrusion which comes in contact in both axial directions" in the present invention.

During operation of the hammer drill 101, the counter weight 151 performs a vibration reducing function of reducing impulsive and cyclic vibration caused in the axial direction of the hammer bit 119. Specifically, when the driving motor 111 is driven with the hammer bit 119 pressed against the workpiece and the rotating element 127 turns once together with the intermediate shaft 125, the swinging ring 129 swings once in the axial direction of the hammer bit 119, which causes the hammer bit 119 to strike once. At this time, the counter weight 151 performs circular arc motion on the shaft 153 in the axial direction of the hammer bit 119 and thereby reduces vibration which is caused in the axial direction of the hammer bit in the body 103 of the hammer drill 101.

In the hammer drill 101 of a type that drives the striker 143 by pressure fluctuations of the air chamber 130*a* of the cylindrical piston 130, air within the air chamber 130*a* is compressed to maximum pressure when the cylindrical piston 130 is moved to the middle region between the bottom dead point and the top dead point. Thereafter, the striker 143 is moved forward by the pressure of the air chamber 130*a* and applies a striking force to the hammer bit 119 via the impact bolt 145, and thus the hammer bit 119 strikes the workpiece. Therefore, the timing at which an impact force is generated in the hammer drill 101 conceivably includes the time at which the striker 143 collides with the hammer bit 119 via the impact bolt 145 and the time at which the hammer bit 119 strikes the workpiece as well as the above-described time at which the air chamber 130*a* reaches maximum pressure. In each of these cases, the impact force is generated in the body 103 in the axial direction of the hammer bit before the cylindrical piston 130 reaches the top dead point.

Therefore, in this embodiment, the counter weight 151 is connected to the swinging ring 129 at a position displaced a predetermined angle (about 90 degrees) forward in the direction of rotation of the rotating element 127 from a position diametrically opposite to the connection between the swinging ring 129 and the cylindrical piston 130. By provision of this construction, the counter weight 151 can be driven in response to the timing of the above-described generation of the impact force. Thus, the movement of the counter weight 151 can be efficiently interlocked with the impact force generated when the air chamber 130*a* reaches maximum pressure and with the impact force generated when the striker 143 collides with the impact bolt 145. Specifically, according to this embodiment, compared with the known construction in which the counter weight 151 is driven in a direction opposite to the direction of rectilinear movement of the cylindrical piston 130, vibration which is caused in the hammer drill 101 in the axial direction of the hammer bit can be more efficiently reduced.

Further, in this embodiment, the concave engagement part 157 is provided in the counter weight 151 and fitted on the outer edge 129*a* of the swinging ring 129 from radially outward such that the counter weight 151 and the swinging ring 129 are connected to each other. Therefore, it is not necessary for the swinging ring 129 to have a special shape, configuration or structure designed to be connected to the counter weight 151, so that the connecting structure can be made simpler and the manufacturing costs can be reduced.

In this embodiment, the counter weight 151 is formed by sheet metal processing. Therefore, in this sheet metal processing of the counter weight 151, the concave engagement part 157 can be formed by bending, so that further cost reduction can be realized.

According to this embodiment, the counter weight 151 performs circular arc motion in the axial direction of the hammer bit 119 on the shaft 153 provided close to the connection between the swinging ring 129 and the cylindrical piston 130. Therefore, the distance between the shaft 153 and the connecting part in which the counter weight 151 is connected to the swinging ring 129 via the concave engagement part 157 can be shortened compared with the known construction in which the counter weight 151 is driven in the direction opposite to the direction of movement of the cylindrical piston 130. As a result, the amplitude (width) of circular arc motion (swing) of the counter weight 151 can be increased and the counter weight 151 can be correspondingly reduced in weight.

According to this embodiment, each of the right and left arms 151*b* of the counter weight 151 has the weight concentrated portion 155. Thus, the weight required for vibration reduction can be easily secured by adjusting the volume of the weight concentrated portion 155. Further, the position of the weight concentrated portion 155 on the arm 151*b* can be adjusted such that the center of gravity of the counter weight 151 comes closer to the axis of the hammer bit 119. Therefore, when the counter weight 151 performs circular arc motion on the shaft 153, unnecessary vibration which is caused by couple of forces generated around a horizontal axis transverse to the rotation axis of the intermediate shaft 125 can be reduced.

Second Embodiment of the Invention

Figure 10:
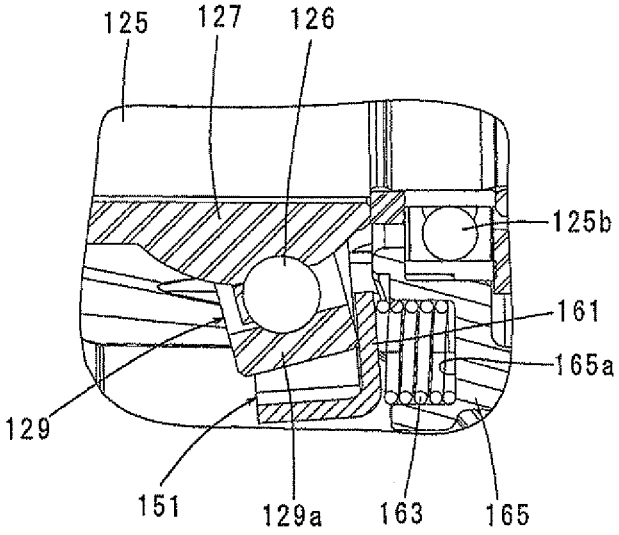
FIG. 10 is a sectional view for illustrating a second embodiment relating to the structure of connecting the counter weight to the swinging ring.

A second embodiment of the present invention is now explained with reference to FIG. 10. This embodiment is a modification to the structure of connecting the counter weight 151 to the swinging ring 129. In the other points, it has the same construction as the above-described first embodiment. Therefore, only the connecting structure is shown and described here. In this embodiment, the connecting part for connecting the counter weight 151 to the swinging ring 129 is formed by a protruding piece 161 that is integrally formed with the counter weight 151, and a biasing spring 163 that presses the protruding piece 161 such that the protruding piece 161 is held in contact with the outer edge 129*a* of the swinging ring 129.

The protruding piece 161 is configured as a flat member that is formed in the connecting region between the semicircular part 151*a* of the counter weight 151 and one of the arms 151*b* by bending. The protruding piece 161 protrudes toward the center of the semicircular part 151*a* and its side surface is opposed to one (rear) side of the outer edge 129*a* of the swinging ring 129. The protruding piece 161 is a feature that corresponds to the "protrusion which come in contact in one axial direction" in the present invention. The biasing spring 163 is disposed between the protruding piece 161 and a fixed member opposed to the protruding piece 161. In this embodiment, a bearing cover 165 which houses the rear bearing 125*b* for supporting the intermediate shaft 125 is utilized as the fixed member. Specifically, the biasing spring 163 is held by a circular recess 165*a* formed in the bearing cover 165, and an end of the biasing spring 163 which protrudes out of the recess 165*a* elastically presses the rear side of the protruding piece 161 in such a manner as to bring the protruding piece 161 in contact with the rear side of the outer edge 129*a* of the swinging ring 129 and hold this state. The biasing spring 163 is a feature that corresponds to the "biasing member" in the present invention.

This embodiment is constructed as described above. Therefore, when the swinging ring 129 is caused to swing, the protruding piece 161 moves following the outer edge 129*a* of the swinging ring 129 while being held in contact with the outer edge 129*a*. Specifically, when a contact region of the swinging ring 129 with the protruding piece 161 moves rearward, the protruding piece 161 is pushed rearward by this contact region. Further, when the contact region of the swinging ring 129 with the protruding piece 161 moves forward, the protruding piece 161 is pushed forward by the biasing force of the biasing spring 163. By provision of this construction, like in the above-described first embodiment, the counter weight 151 performs circular arc motion on the shaft 153 in conjunction with the swinging movement of the swinging ring 129, so that vibration caused in the hammer drill 101 in the axial direction of the hammer bit can be reduced.

In this case, according to this embodiment, the protruding piece 161 can be constantly held in contact with the outer edge 129*a* of the swinging ring 129 by the biasing force of the biasing spring 163, so that vibration and noise can be avoided which may be caused if the protruding piece 161 and the outer edge 129*a* hit against each other.

According to this embodiment, the protruding piece 161 is provided in the counter weight 151 and held in contact with the outer edge 129*a* of the swinging ring 129 by the biasing spring 163, so that the counter weight 151 is connected to the swinging ring 129. Therefore, it is not necessary for the swinging ring 129 to have a special shape, configuration or structure designed to be connected to the counter weight 151, so that the connecting structure can be made simpler and the manufacturing costs can be reduced. Further, the protruding piece 161 can be formed by bending in the sheet metal processing of the counter weight 151, so that further cost reduction can be realized.

In the above-described embodiment, the counter weight 151 is connected to the swinging ring 129 at a position displaced a predetermined angle forward in a direction of rotation of the rotating element 127 from a position diametrically opposite to the connection between the swinging ring 129 and the cylindrical piston 130. In the present invention, however, the connecting position is not particularly limited. For example, the counter weight 151 may be connected to the swinging ring 129 at a position diametrically opposite to the connection between the swinging ring 129 and the cylindrical piston 130 and driven in opposite phase with respect to rectilinear movement of the cylindrical piston 130.

Further, in this embodiment, the counter weight 151 performs circular arc motion in the axial direction of the hammer bit 119, but it may be constructed to perform rectilinear motion. The counter weight 151 may be formed by methods other than sheet metal processing, such as sintering, forging and molding. Further, the concave engagement part 157 and the protruding piece 161 are integrally formed with the counter weight 151, but they may be separately formed and mounted to the counter weight 151.

In the second embodiment, rubber may be used in place of the biasing spring 163, and part of the gear housing 107 may be used as the fixed member for holding the biasing spring 163 in place of the bearing cover 165. Further, it may be constructed such that the protruding piece 161 is brought into contact with the front side of the outer edge 129*a* of the swinging ring 129 and pressed by the biasing spring 163.

In the above-described embodiments, the electric hammer drill 101 is explained as a representative example of the impact tool, but the present invention is not limited to this and can be applied to an electric hammer in which the hammer bit 119 performs only axial striking movement.

Having regard to the above-described invention, following aspects can be provided:

Aspect 1 An impact tool which performs a predetermined operation on a workpiece by axial striking movement of a tool bit coupled to a front end region of a tool body, comprising:

a motor that is housed in the tool body, a drive shaft that is disposed in parallel to an axial direction of the tool bit and rotationally driven by the motor, a ring-like member that is rotatably mounted onto the drive shaft and caused to swing in the axial direction of the tool bit by rotation of the drive shaft, a tool driving mechanism that is connected to one end region of the ring-like member in a direction transverse to the axial direction of the tool bit and is caused to rectilinearly move in the axial direction of the tool bit by swinging movement of the ring-like member and thereby rectilinearly drives the tool bit, and a counter weight that is mounted movably in the axial direction of the tool bit and reduces vibration which is caused in the tool body in the axial direction of the tool bit during operation, wherein:

the counter weight has a connecting part that comes in contact with an outer edge of the ring-like member in at least one of axial directions of the tool bit, and the counter weight is connected to the ring-like member via the connecting part.

Aspect 2 The impact tool as defined in aspect 1, wherein the connecting part is formed in the counter weight and comprises a protrusion that comes in contact with the outer edge of the ring-like member in both axial directions of the tool bit.

Aspect 3 The impact tool as defined in aspect 1, wherein the connecting part is formed in the counter weight and includes a protrusion that comes in contact with the outer edge of the ring-like member in the one axial direction of the tool bit, and a biasing member that applies a biasing force to constantly hold the protrusion in contact with said outer edge.

Aspect 4 The impact tool as defined in any one of aspects 1 to 3, wherein the counter weight has a center of rotation close to a connection between the ring-like member and the cylindrical piston, and when the ring-like member is caused to swing, the counter weight is driven by the ring-like member to perform circular arc motion on the center of rotation in the axial direction of the tool bit, thereby reducing vibration in the axial direction of the tool bit.

Aspect 5 The impact tool as defined in any one of aspects 1 to 4, wherein the tool driving mechanism has a cylindrical piston that is caused to rectilinearly move in the axial direction of the tool bit by swinging movement of the ring-like member, and a striking element that is caused to rectilinearly move in the axial direction of the tool bit via pressure fluctuations caused within the cylindrical piston by rectilinear movement of the cylindrical piston, and thereby rectilinearly drives the tool bit, and wherein the ring-like member is connected to the counter weight at a position displaced a predetermined distance forward in a direction of rotation of the drive shaft from a position diametrically opposite to the one end region of the ring-like member at which the ring-like member is connected to the cylindrical piston.

Aspect 6 The impact tool as defined in any one of aspects 1 to 5, wherein the counter weight has a center of gravity between the connection of the tool driving mechanism with the ring-like member and a rotation axis of the drive shaft.

Aspect 7 The impact tool as defined in any one of aspects 1 to 5, wherein the counterweight is formed by processing a generally band-like metal plate.

Aspect 8 The impact tool as defined in aspect 7, wherein the counterweight has a weight concentrated portion at a predetermined region of the counterweight.

Aspect 9 The impact tool as defined in aspect 7 or 8, wherein the connecting part has a concave engagement part and the counter weight is connected to the ring-like member via the concave engagement part.

Aspect 10 The impact tool as defined in any one of aspects 1 to 9, wherein the connecting part has a protruding piece which is integrally formed with the counter weight, and a biasing spring which presses the protruding piece such that the protruding piece is held in contact with the outer edge ring-like member.

Aspect 11 The impact tool as defined in any one of aspects 1 to 10, wherein the ring-like member is connected to the counter weight at a position displaced a predetermined distance forward in a direction of rotation of the drive shaft from a position diametrically opposite to the one end region of the ring-like member at which the ring-like member is connected to the cylindrical piston.

Aspect 12 An impact tool which performs a predetermined operation on a workpiece by axial striking movement of a tool bit coupled to a front end region of a tool body, comprising:

a motor that is housed in the tool body, a drive shaft that is disposed in parallel to an axial direction of the tool bit and rotationally driven by the motor, a ring-like member that is rotatably mounted onto the drive shaft and caused to swing in the axial direction of the tool bit by rotation of the drive shaft, a cylindrical piston that is connected to one end region of the ring-like member in a direction transverse to the axial direction of the tool bit and is caused to rectilinearly move in the axial direction of the tool bit by swinging movement of the ring-like member, a striking element that is caused to rectilinearly move in the axial direction of the tool bit via pressure fluctuations caused within the cylindrical piston by rectilinear movement of the cylindrical piston, and thereby rectilinearly drives the tool bit, and a counter weight that is mounted movably in the axial direction of the tool bit and reduces vibration which is caused in the tool body in the axial direction of the tool bit during operation, wherein:

the ring-like member is connected to the counter weight at a position displaced a predetermined distance forward in a direction of rotation of the drive shaft from a position diametrically opposite to the one end region of the ring-like member at which the ring-like member is connected to the cylindrical piston.

Aspect 13 The impact tool as defined in aspect 12, wherein the counter weight has a connecting part that comes in contact with an outer edge of the ring-like member in at least one of axial directions of the tool bit, and the counter weight is connected to the ring-like member via the connecting part.

Aspect 14 The impact tool as defined in aspect 13, wherein the connecting part is formed in the counter weight and comprises a protrusion that comes in contact with the outer edge of the ring-like member in both axial directions of the tool bit.

Aspect 15 The impact tool as defined in aspect 13, wherein the connecting part is formed in the counter weight and includes a protrusion that comes in contact with the outer edge of the ring-like member in the one axial direction of the tool bit, and a biasing member that applies a biasing force to constantly hold the protrusion in contact with said outer edge.

Aspect 16 The impact tool as defined in any one of aspects 12 to 15, wherein the counter weight has a center of rotation close to a connection between the ring-like member and the cylindrical piston, and when the ring-like member is caused to swing, the counter weight is driven by the ring-like member to perform circular arc motion on the center of rotation in the axial direction of the tool bit, thereby reducing vibration in the axial direction of the tool bit.

Aspect 17 The impact tool as defined in any one of aspects 12 to 16, wherein the counter weight has a center of gravity between the connection of the cylindrical piston with the ring-like member and a rotation axis of the drive shaft.

DESCRIPTION OF NUMERALS

101 hammer drill (impact tool)
103 body (tool body)
105 motor housing
107 gear housing
107*a* inner housing
109 handgrip
109*a* trigger
111 driving motor (motor)
113 motion converting mechanism
115 striking mechanism
117 power transmitting mechanism
119 hammer bit (tool bit)
121 driving gear
123 driven gear
124 connecting shaft
125 intermediate shaft (drive shaft)
125*a*, 125*b* bearing
126 bearing
127 rotating element
128 swinging rod
129 swinging ring (ring-like member)
130 cylindrical piston (tool driving mechanism)
130*a* air chamber
131 first transmission gear
133 second transmission gear
137 tool holder
143 striker (tool driving mechanism, striking element)
145 impact bolt
151 counter weight
151*a* semicircular part
151*b* arm
153 shaft
155 weight concentrated portion
157 concave engagement part (connecting part)
157*a*, 157*b* front and rear flat parts (protrusions)
161 protruding piece (connecting part, protrusion)
163 biasing spring (connecting part, biasing member)
165 bearing cover
165*a* recess

The invention claimed is:

1. An impact tool which is configured to perform a predetermined operation on a workpiece by axial striking movement of a tool bit coupled to a front end region of a tool body, comprising:

a motor that is housed in the tool body, a drive shaft that is disposed in parallel to an axial direction of the tool bit and rotationally driven by the motor, a ring-like member that is rotatably mounted onto the drive shaft and caused to swing in the axial direction of the tool bit by rotation of the drive shaft, a tool driving mechanism that is connected to one end region of the ring-like member in a direction transverse to the axial direction of the tool bit and is caused to rectilinearly move in the axial direction of the tool bit by swinging movement of the ring-like member and thereby rectilinearly drives the tool bit, and a counter weight that is mounted movably in the axial direction of the tool bit and reduces vibration which is caused in the tool body in the axial direction of the tool bit during operation, wherein:

the counter weight has a connecting part, and the counter weight is connected to the ring-like member via the connecting part, and the connecting part is formed in the counter weight and comprises a protrusion that comes in contact with an outer edge of the ring-like member in both axial directions of the tool bit.

2. The impact tool as defined in claim 1, wherein the connecting part is formed in the counter weight and includes a protrusion that comes in contact with the outer edge of the ring-like member in the one axial direction of the tool bit, and a biasing member that applies a biasing force to constantly hold the protrusion in contact with said outer edge.

3. The impact tool as defined in claim 1, wherein the counter weight has a center of rotation close to a connection between the ring-like member and a cylindrical piston, and when the ring-like member is caused to swing, the counter weight is driven by the ring-like member to perform circular arc motion on the center of rotation in the axial direction of the tool bit, thereby reducing vibration in the axial direction of the tool bit.

4. The impact tool as defined in claim 1, wherein the tool driving mechanism has a cylindrical piston that is caused to rectilinearly move in the axial direction of the tool bit by swinging movement of the ring-like member, and a striking element that is caused to rectilinearly move in the axial direction of the tool bit via pressure fluctuations caused within the cylindrical piston by rectilinear movement of the cylindrical piston, and thereby rectilinearly drives the tool bit, and wherein the ring-like member is connected to the counter weight at a position displaced a predetermined distance forward in a direction of rotation of the drive shaft from a position diametrically opposite to the one end region of the ring-like member at which the ring-like member is connected to the cylindrical piston.

5. The impact tool as defined in claim 1, wherein the counter weight has a center of gravity between the connection of the tool driving mechanism with the ring-like member and a rotation axis of the drive shaft.

6. The impact tool as defined in claim 1, wherein the counterweight is formed by processing a generally band-like metal plate.

7. The impact tool as defined in claim 6, wherein the counterweight has a weight concentrated portion at a predetermined region of the counterweight.

8. The impact tool as defined in claim 6, wherein the connecting part has a concave engagement part and the counter weight is connected to the ring-like member via the concave engagement part.

9. The impact tool as defined in claim 1, wherein the connecting part has a protruding piece which is integrally formed with the counter weight, and a biasing spring which presses the protruding piece such that the protruding piece is held in contact with the outer edge ring-like member.

10. The impact tool as defined in claim 1, wherein the ring-like member is connected to the counter weight at a position displaced a predetermined distance forward in a direction of rotation of the drive shaft from a position diametrically opposite to the one end region of the ring-like member at which the ring-like member is connected to a cylindrical piston.

11. An impact tool which is configured to perform a predetermined operation on a workpiece by axial striking movement of a tool bit coupled to a front end region of a tool body, comprising:

a motor that is housed in the tool body, a drive shaft that is disposed in parallel to an axial direction of the tool bit and rotationally driven by the motor, a ring-like member that is rotatably mounted onto the drive shaft and caused to swing in the axial direction of the tool bit by rotation of the drive shaft, a cylindrical piston that is connected to one end region of the ring-like member in a direction transverse to the axial direction of the tool bit and is caused to rectilinearly move in the axial direction of the tool bit by swinging movement of the ring-like member, a striking element that is caused to rectilinearly move in the axial direction of the tool bit via pressure fluctuations caused within the cylindrical piston by rectilinear movement of the cylindrical piston, and thereby rectilinearly drives the tool bit, and a counter weight that is mounted movably in the axial direction of the tool bit and reduces vibration which is caused in the tool body in the axial direction of the tool bit during operation, wherein:

the ring-like member is connected to the counter weight at a position displaced a predetermined distance forward in a direction of rotation of the drive shaft from a position diametrically opposite to the one end region of the ring-like member at which the ring-like member is connected to the cylindrical piston, and a connecting part is formed in the counter weight and comprises a protrusion that comes in contact with an outer edge of the ring-like member in both axial directions of the tool bit.

12. An impact tool which is configured to perform a predetermined operation on a workpiece by axial striking movement of a tool bit coupled to a front end region of a tool body, comprising:

a motor that is housed in the tool body, a drive shaft that is disposed in parallel to an axial direction of the tool bit and rotationally driven by the motor, a ring-like member that is rotatably mounted onto the drive shaft and caused to swing in the axial direction of the tool bit by rotation of the drive shaft, a tool driving mechanism that is connected to one end region of the ring-like member in a direction transverse to the axial direction of the tool bit and is caused to rectilinearly move in the axial direction of the tool bit by swinging movement of the ring-like member and thereby rectilinearly drives the tool bit, and a counter weight that is mounted movably in the axial direction of the tool bit and reduces vibration which is caused in the tool body in the axial direction of the tool bit during operation, wherein:

the counter weight has a connecting part that comes in contact with an outer edge of the ring-like member in at least one of axial directions of the tool bit, and the counter weight is connected to the ring-like member via the connecting part, and the connecting part is formed in the counter weight and includes a protrusion that comes in contact with the outer edge of the ring-like member in the one axial direction of the tool bit, and a biasing member that applies a biasing force to constantly hold the protrusion in contact with the outer edge.

13. An impact tool which is configured to perform a predetermined operation on a workpiece by axial striking movement of a tool bit coupled to a front end region of a tool body, comprising:

a motor that is housed in the tool body, a drive shaft that is disposed in parallel to an axial direction of the tool bit and rotationally driven by the motor, a ring-like member that is rotatably mounted onto the drive shaft and caused to swing in the axial direction of the tool bit by rotation of the drive shaft, a tool driving mechanism that is connected to one end region of the ring-like member in a direction transverse to the axial direction of the tool bit and is caused to rectilinearly move in the axial direction of the tool bit by swinging movement of the ring-like member and thereby rectilinearly drives the tool bit, and a counter weight that is mounted movably in the axial direction of the tool bit and reduces vibration which is caused in the tool body in the axial direction of the tool bit during operation, wherein:

the counter weight has a connecting part that comes in contact with an outer edge of the ring-like member in at least one of axial directions of the tool bit, and the counter weight is connected to the ring-like member via the connecting part, the counterweight is formed by processing a generally band-like metal plate, and the connecting part has a protruding piece which is integrally formed with the counter weight, and a biasing spring which presses the protruding piece such that the protruding piece is held in contact with the outer edge of the ring-like member.

* * * * *